US009138058B2

(12) United States Patent
Koolhaas et al.

(10) Patent No.: US 9,138,058 B2
(45) Date of Patent: Sep. 22, 2015

(54) SEATING DEVICE HAVING A HEIGHT ADJUSTMENT MECHANISM

(71) Applicants: Rem Koolhaas, Rotterdam (NL); Andrew Blair Hector, Red Hill, PA (US)

(72) Inventors: Rem Koolhaas, Rotterdam (NL); Andrew Blair Hector, Red Hill, PA (US)

(73) Assignee: Office for Metropolitan Architecture (O.M.A.) Stedebouw B.V, Rotterdam (NL)

( * ) Notice: Subject to any disclaimer, the term of this patent is extended or adjusted under 35 U.S.C. 154(b) by 0 days.

(21) Appl. No.: 14/253,152

(22) Filed: Apr. 15, 2014

(65) Prior Publication Data

US 2014/0312667 A1 Oct. 23, 2014

Related U.S. Application Data

(60) Provisional application No. 61/814,926, filed on Apr. 23, 2013.

(51) Int. Cl.

| | |
|---|---|
| ***A47C 1/00*** | (2006.01) |
| ***A47C 9/00*** | (2006.01) |
| ***A47C 3/30*** | (2006.01) |
| ***A47C 3/16*** | (2006.01) |

(52) U.S. Cl.
CPC .... *A47C 3/30* (2013.01); *A47C 3/16* (2013.01)

(58) Field of Classification Search
CPC ..... A47C 3/30; A47C 3/16
USPC ..... 297/217.5, 461, 462, 423.45, 423.44, 297/423.41, 339, 344.19
See application file for complete search history.

(56) References Cited

U.S. PATENT DOCUMENTS

| | | | | |
|---|---|---|---|---|
| 2,742,953 | A * | 4/1956 | Kudrna | 248/405 |
| 3,312,437 | A | 4/1967 | Barth | |
| 4,130,263 | A | 12/1978 | Roericht | |
| 4,929,021 | A * | 5/1990 | Kaye | 297/188.09 |
| 5,112,103 | A | 5/1992 | Downer | |
| 6,817,667 | B2 | 11/2004 | Pennington et al. | |
| 6,824,218 | B1 | 11/2004 | van Hekken | |

(Continued)

FOREIGN PATENT DOCUMENTS

| | | |
|---|---|---|
| DE | 4040268 A1 | 6/1992 |
| EP | 2422647 A1 | 2/2012 |

OTHER PUBLICATIONS

International Search Report for PCT/US2014/034505 dated Jul. 30, 2014.

(Continued)

*Primary Examiner* — Milton Nelson, Jr.
(74) *Attorney, Agent, or Firm* — Buchanan Ingersoll & Rooney PC

(57) ABSTRACT

A chair includes a base, a seat assembly comprising a seat, and a height adjustment mechanism attached between the base and the seat assembly. The height adjustment mechanism vertically moves a position of the seat from a first position to a second position that is higher than the first position. The height adjustment mechanism includes a first gas spring attached to the base, a second gas spring attached to the seat assembly, and a support attached between the first gas spring and the second gas spring. The first gas spring is at least partially within a lower portion of the base and the second gas spring is at least partially within the seat assembly. The seat assembly is movable relative to the lower portion of the base.

25 Claims, 5 Drawing Sheets

(56) References Cited

U.S. PATENT DOCUMENTS

| | | | | |
|---|---|---|---|---|
| 6,834,916 | B2 | 12/2004 | Volkman et al. | |
| 7,198,329 | B1 | 4/2007 | Larson | |
| 7,478,878 | B2 | 1/2009 | Oettinger | |
| 7,887,131 | B2 | 2/2011 | Chadwick et al. | |
| 8,029,060 | B2 | 10/2011 | Parker et al. | |
| 8,136,876 | B2 | 3/2012 | Bellvis Castillo et al. | |
| 8,157,329 | B2 | 4/2012 | Masoud et al. | |
| 8,167,373 | B2 | 5/2012 | Allison et al. | |
| 8,216,416 | B2 | 7/2012 | Allison et al. | |
| D664,779 | S * | 8/2012 | Weber et al. | D6/349 |
| 2003/0168901 | A1 | 9/2003 | Wilkerson et al. | |
| 2006/0006715 | A1 | 1/2006 | Chadwick et al. | |
| 2007/0138850 | A1 * | 6/2007 | Oettinger | 297/271.5 |
| 2008/0290712 | A1 | 11/2008 | Parker et al. | |
| 2009/0001788 | A1 * | 1/2009 | Lenz et al. | 297/217.4 |
| 2009/0315376 | A1 | 12/2009 | Nishiwaki | |

OTHER PUBLICATIONS

Written Opinion of the International Searching Authority for PCT/US2014/034505 dated Jul. 30, 2014.

* cited by examiner

SEATING DEVICE HAVING A HEIGHT ADJUSTMENT MECHANISM

CROSS-REFERENCE TO RELATED APPLICATIONS

The present application claims priority to U.S. Provisional Patent Application No. 61/814,926, which was filed on Apr. 23, 2013.

FIELD OF INVENTION

The present invention relates to chairs.

BACKGROUND OF THE INVENTION

Chairs often include a base that supports a seat. One type of chair is a stool. A stool may be a relatively short chair that does not have a backrest, for example. Examples of stools may be appreciated from U.S. Pat. Nos. 8,136,876, 7,478,878, 6,834,916, 5,112,103, 4,130,263, 3,312,437, and D664,779. Other types of chairs such as lounge chairs or office chairs may have a backrest. Examples of such chairs may be appreciated from U.S. Pat. Nos. 8,216,416, 8,167,373, 8,157,329, 8,029,060, 7,887,131, 7,198,329, 6,824,218, and 6,817,667 and U.S. Pat. App. Pub. Nos. 2003/0168901, 2006/0006715, and 2008/0290712.

We have determined that a new chair design is needed. For instance, we have determined that stools often fail to permit a user to easily adjust the seat of the stool. For example, stools are often configured to have an affixed height and a seat that is not height adjustable. Further, stools often fail to provide a structure capable of providing an aesthetic effect that permits viewability of a height adjustment mechanism while also preventing a user form being exposed to pinch points or other areas of possible user injury that can be associated with such a mechanism.

SUMMARY OF THE INVENTION

A chair can include a base, an upper portion that is movable relative to the base, a seat attached to the upper portion, and a height adjustment mechanism attached between the base and the upper portion. The height adjustment mechanism can vertically move a position of the seat from a first position to a second position that is higher than the first position. The height adjustment mechanism may comprise a first gas spring having a base member and a first extendable member that is extendable out of the base member, a second gas spring having a receptacle member and a second extendable member extendable out of the receptacle member, and a support attached between the first gas spring and the second gas spring. One of the base member and the first extendable member is attached to the support and the other of the base member and the first extendable member is attached to the base. One of the receptacle member and the second extendable member is attached to the upper portion and the other of the receptacle member and the second extendable member is attached to the support. The first gas spring may be at least partially within a lower portion of the base and the second gas spring may be at least partially within the upper portion of the chair.

The support may have an upper end and a lower end. An end of the one of the first extendable member and the base member is attached adjacent to the upper end of the support and an end of the one of the second extendable member and the receptacle member of the second gas spring is attached adjacent to the lower end of the support. For instance, an end of the first extendable member may be attached to the upper end of the support and an end of the second extendable member may be attached to the lower end of the support. As another example, an end of the first extendable member may be attached to the upper end of the support and an end of the receptacle member may be attached to the lower end of the support. As yet another example, an end of the base member may be attached to the upper end of the support and an end of the receptacle member may be attached to the lower end of the support. As yet another example, an end of the base member may be attached to the upper end of the support and an end of the second extendable member may be attached to the lower end of the support.

The support may be configured to have a first receptacle defined within the upper end of the support to receive and retain the end of the one of the first extendable member and the base member and the support may also have a second hole defined within the lower end of the support to receive and retain the end of the one of the second extendable member and the receptacle member of the second gas spring. The first hole may be defined on a first side of the support and the second hole may be defined on a second side of the support that is opposite the first side of the support.

Embodiments of the chair may also include an encasing member that is movably attached to at least one of the base and the upper portion. The encasing member may be positioned to encase at least a portion of the height adjustment mechanism such that the height adjustment mechanism is fully encased between the base, the upper portion of the chair, and the encasing member. In some embodiments, the encasing member may be comprised of a material such that the encasing member is clear and at least portions of the first and second gas spring are viewable through the encasing member when the seat is in the second position. In other embodiments, the encasing member may have a particular color that is opaque and hides the height adjustment mechanism. The encasing member may be slideable along a portion of the base when the seat is raised from the first position to the second position via movement of the first gas spring or may be otherwise movable adjacent to the base when the seat is raised from the first position to the second position via movement of the first gas spring. The encasing member may also be slideable along a portion of the upper portion of the chair or may otherwise be movable adjacent to the upper portion of the chair when the seat is raised from the first position to the second position via movement of the second gas spring.

In some embodiments, an upper portion of the encasing member may be attached within the upper portion of the chair and a lower portion of the encasing member may be attached within a lower portion of the base. The encasing member may be a tubular structure, a telescoping structure or may be a polygonal shaped structure that has an inner channel formed therein that is sized to encase at least a portion of the first and second gas springs.

Embodiments of the chair may also include a first actuator and a second actuator. The first actuator may be movably attached to the first gas spring to actuate movement of the first extendable member of the first gas spring for vertical movement of the seat. The second actuator may be movably attached to the second gas spring to actuate movement of the second extendable member of the second gas spring for vertical movement of the seat.

In yet other embodiments of the chair, the chair may include a base, a seat assembly comprising a seat, and a height adjustment mechanism attached between the base and the seat assembly. The height adjustment mechanism may vertically move a position of the seat from a first position to a second position that is higher than the first position. The height adjustment mechanism may include a first gas spring attached to the base, a second gas spring attached to the seat assembly, and a support attached between the first gas spring and the second gas spring. The first gas spring may be at least partially within a lower portion of the base and the second gas spring may be at least partially within the seat assembly. The seat assembly may be movable relative to the lower portion of the base via movement of the first gas spring, second gas spring, or both the first and second gas springs.

An encasing member may also be included in the chair. The encasing member may have an upper portion attached to the seat assembly and a lower portion attached to the base. For instance, the encasing member may be movably attached to at least one of the base and the seat assembly. In some embodiments, the encasing member may be positioned to encase at least a portion of the height adjustment mechanism such that the height adjustment mechanism is fully encased between the base, the seat assembly and the encasing member.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of the chair are shown in the accompanying drawings. It should be appreciated that like reference numbers used in the drawings may identify like components.

DETAILED DESCRIPTION OF EXEMPLARY EMBODIMENTS

Figure 1:
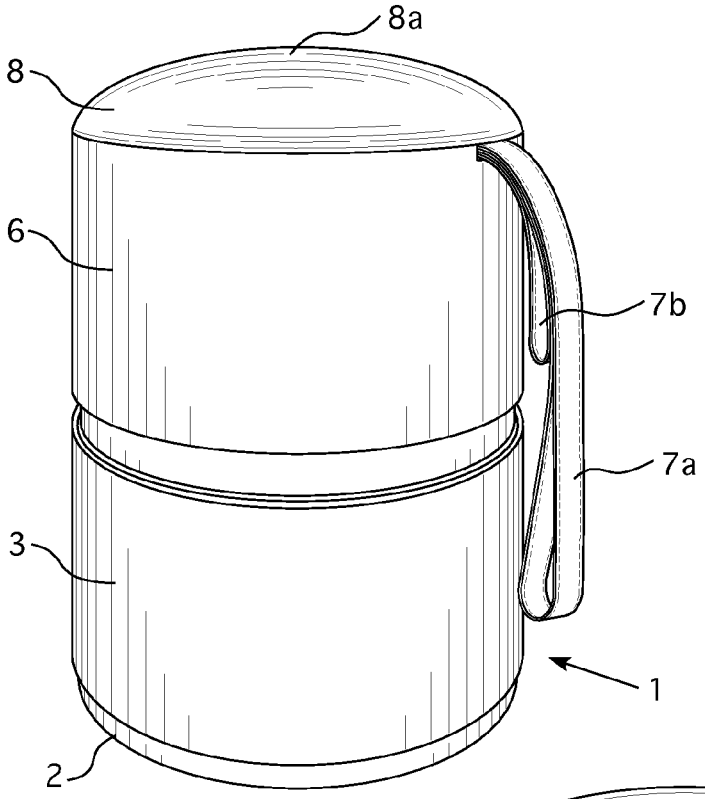
FIG. 1 is a perspective view of a first exemplary embodiment of the chair in a first position.

A chair 1 may include a base 3 that has a rounded bottom 2 shaped to permit rockability of the chair. The base 3 may be connected to an upper portion 6 via a height adjustment mechanism 5. The upper portion 6 may be attached to a seat 8. In some embodiments, the seat 8 may be considered to be part of a seat assembly and the upper portion 6 may be another component of the seat assembly that is attached to the base via the height adjustment mechanism.

Figure 2:
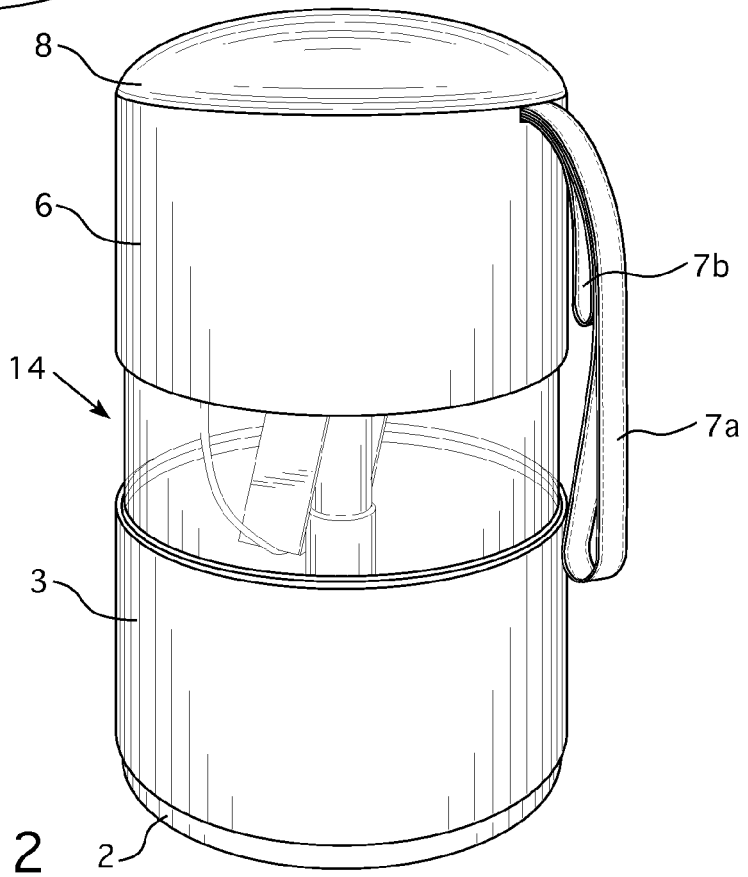
FIG. 2 is a perspective view of the first exemplary embodiment of the chair in a second position in which the seat is at a position that is higher than the position of the seat when the chair is in the first position.
Figure 3:
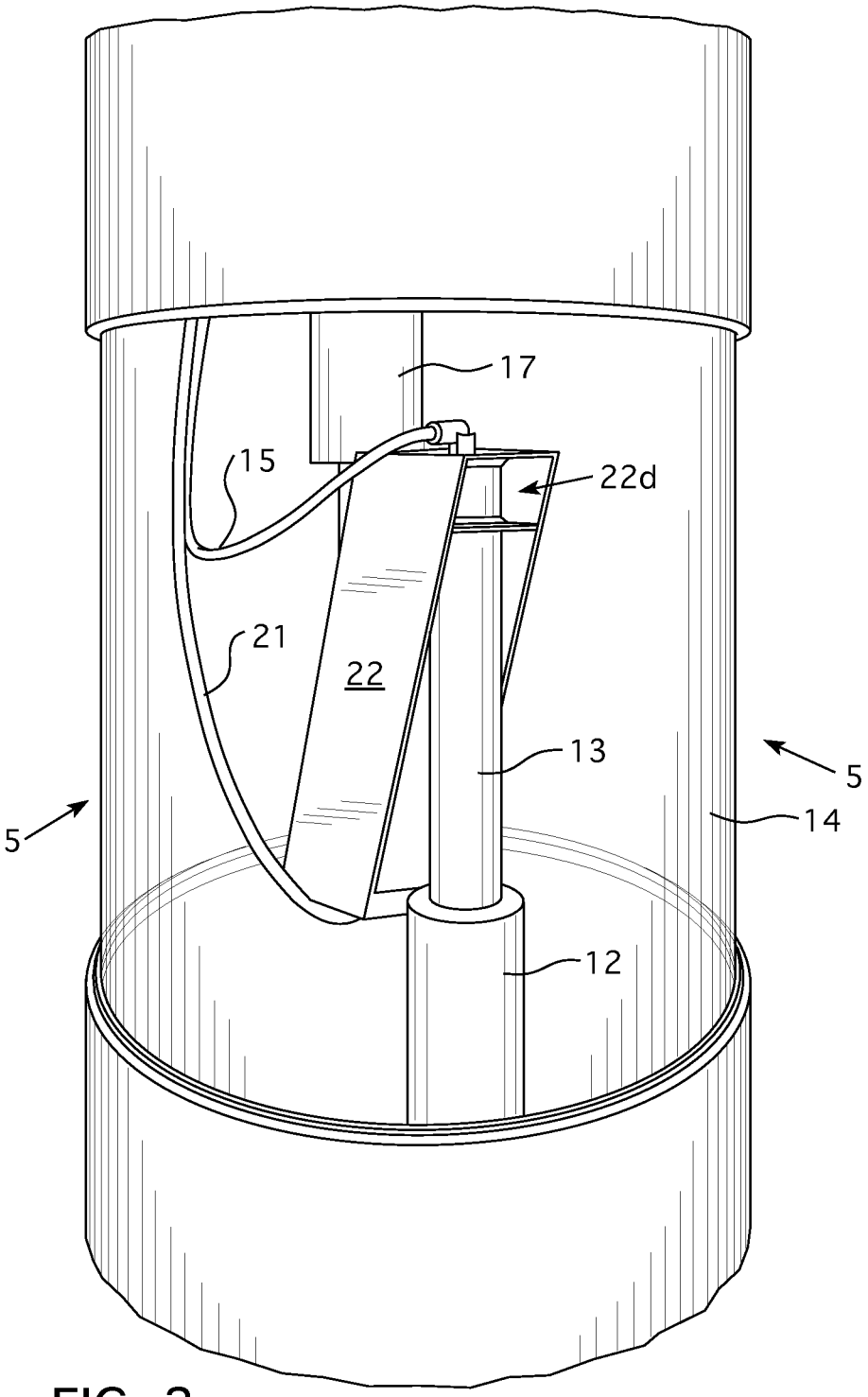
FIG. 3 is a fragmentary view of the first exemplary embodiment of the chair in the second position.
Figure 4:
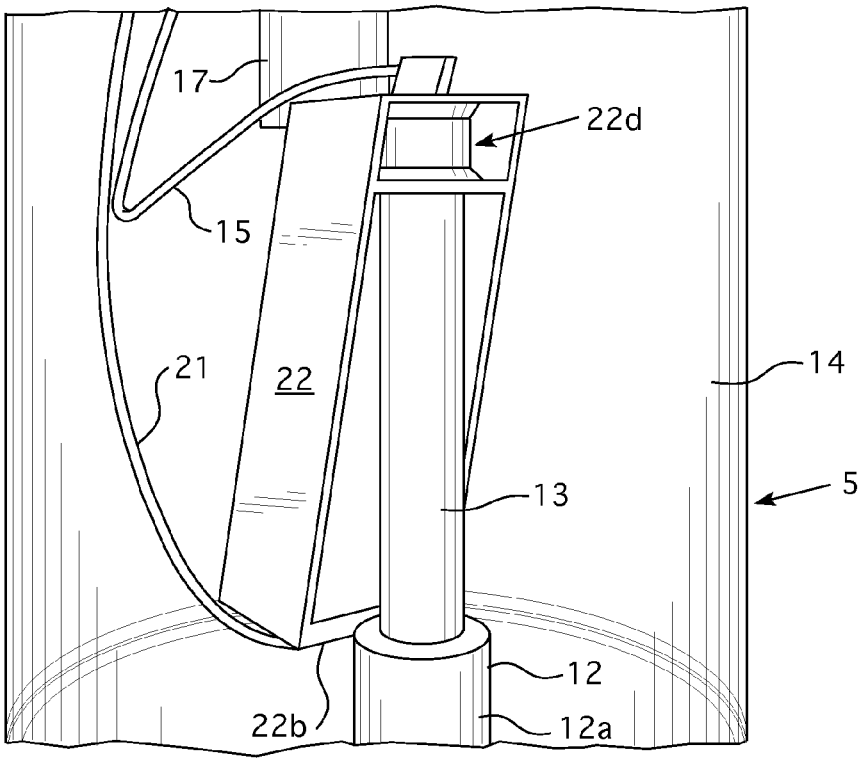
FIG. 4 is an enlarged fragmentary view of the first exemplary embodiment of the chair in the second position.
Figure 5:
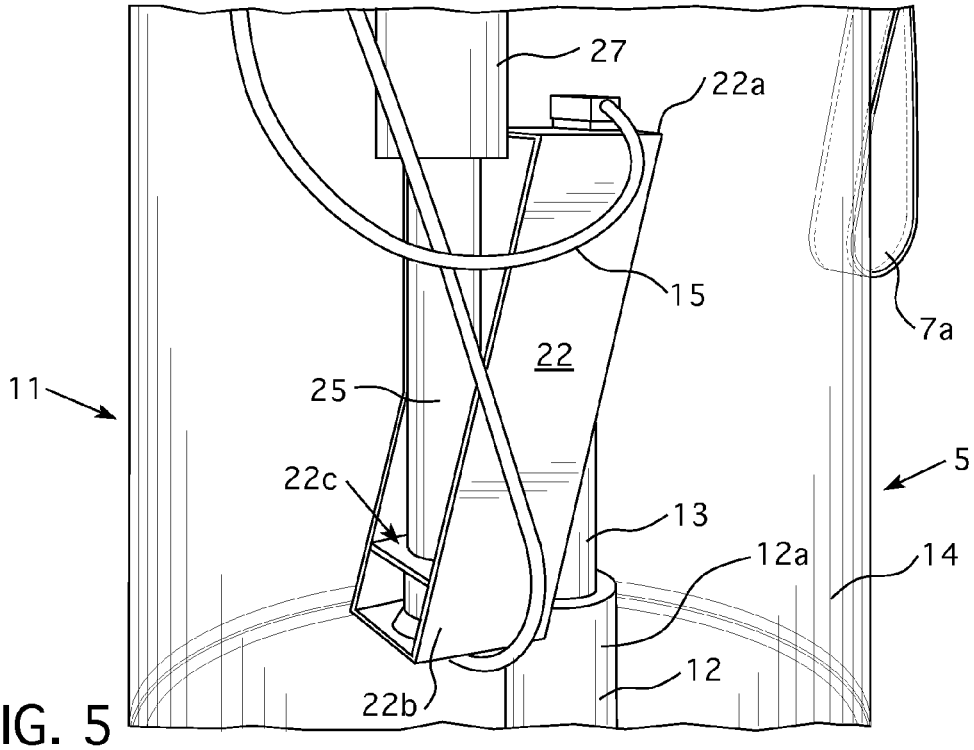
FIG. 5 is an enlarged fragmentary view of the first exemplary embodiment of the chair in the second position.
Figure 6:
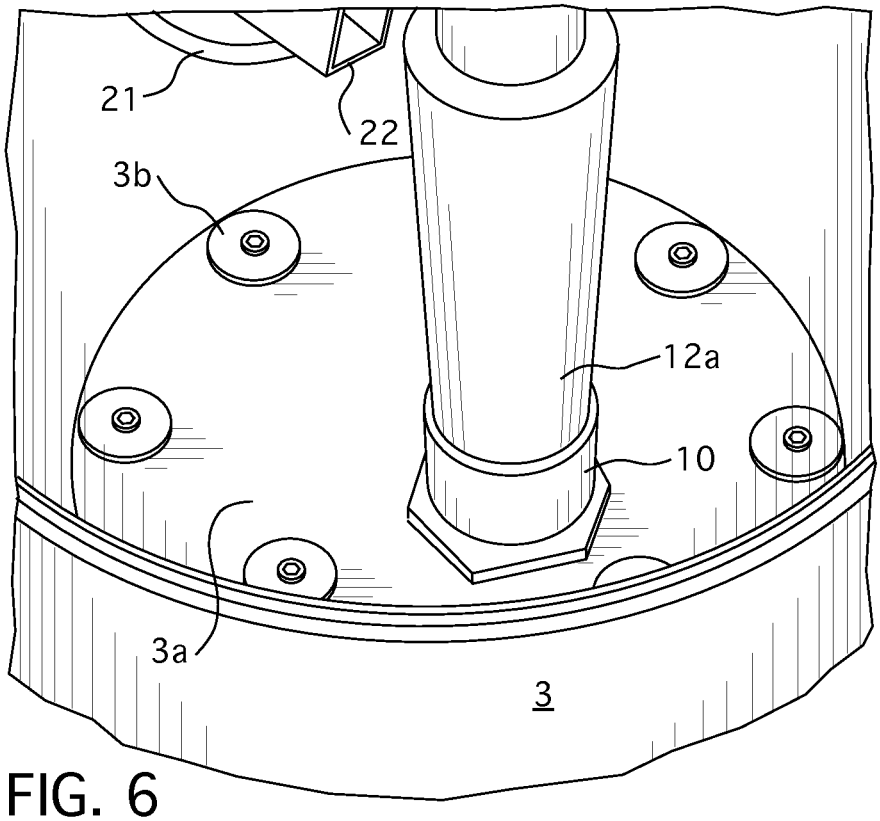
FIG. 6 is a perspective view of an internal bottom portion of the first exemplary embodiment of the chair.
Figure 7:
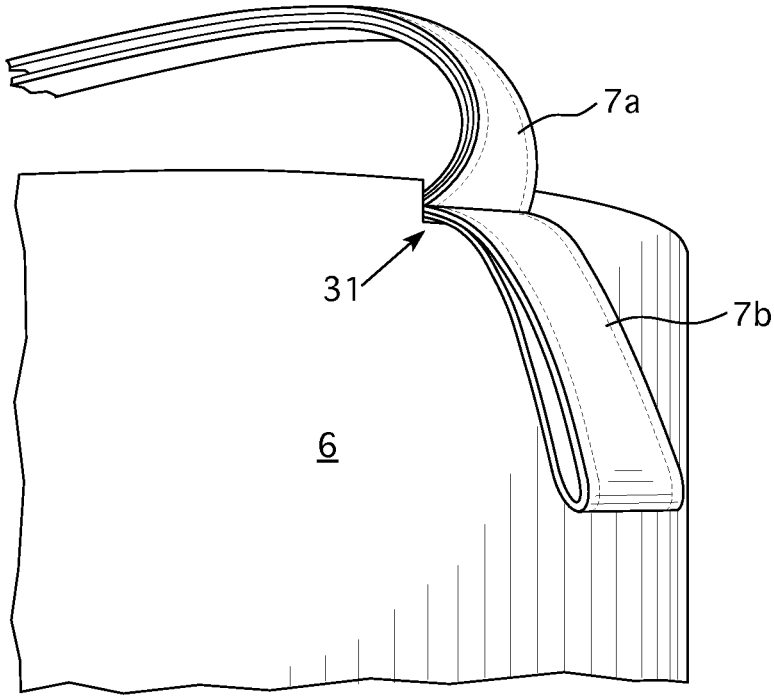
FIG. 7 is a fragmentary perspective view of a top portion of the first exemplary embodiment of the chair with the upper portion of the seat cut away and the straps moved into a split apart position.
Figure 8:
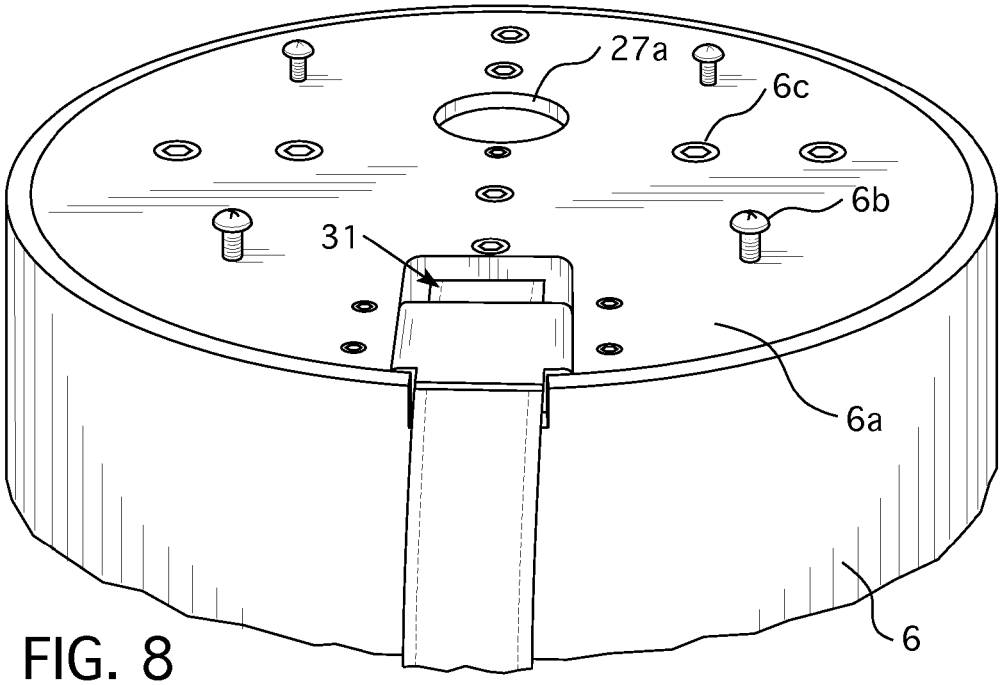
FIG. 8 is a perspective view of the top portion of the first exemplary embodiment of the chair with the seat cut away.
Figure 9:
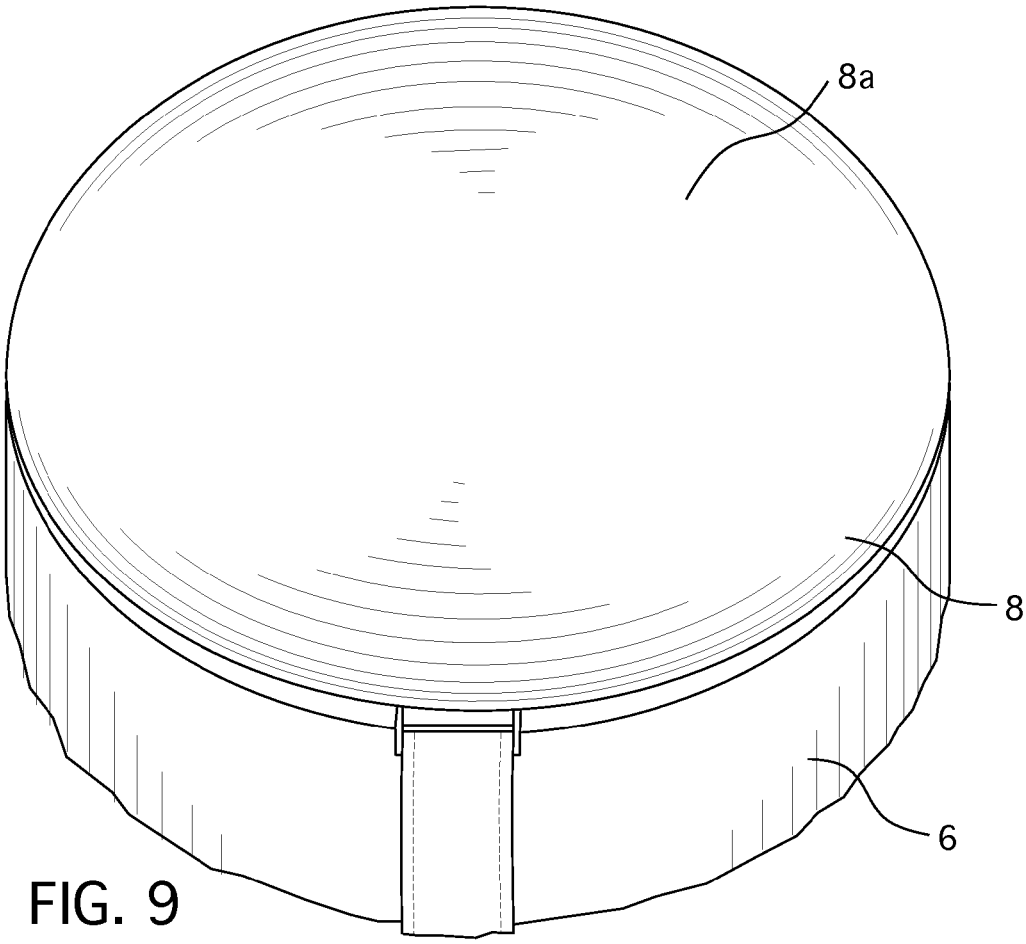
FIG. 9 is a perspective view of the top portion of the first exemplary embodiment of the chair

The seat 8 may include a top cushion assembly that has an upper convex surface 8*a*. A first strap 7*a* may be connected to the height adjustment mechanism to actuate height adjustment. The second strap 7*b* may also be attached to the height adjustment mechanism to actuate height adjustment of the seat. As may be appreciated from FIGS. 1-2, the first and second straps may be manipulated by a user to actuate height adjustment of the seat 8 so that the seat is movable from a lower position to a higher position and vice versa.

In an alternative to the first and second straps 7*a* and 7*b*, different actuators may be utilized such as a button or lever mechanically interconnected to the height adjustment mechanism to actuate height adjustment of the upper portion 6 and seat 8. For instance, a lever or button may be connected to a gas spring via a cable, wire, or other elongated member that is moved to actuate height adjustment. As another alternative, the actuator may instead be a knob, handle, or other type of control element that is movable to cause interconnected members to move to actuate the height adjustment mechanism to adjust the vertical position of the seat 8.

The height adjustment mechanism 5 may be configured to provide a desired range of height adjustment for the seat 8 so that the seat is positionable from a lower location to a higher location and vice versa. The height adjustment mechanism is preferably configured so that it provides a continuous range of adjustment from the uppermost position of the seat 8 (e.g. when the mechanism is fully extended) to the lowermost position of the seat (e.g. when the mechanism is fully retracted).

In one embodiment, the height adjustment mechanism 5 is encased by an encasing member 14 such as a transparent tubular element, such as a clear polymeric tube or clear polymeric pipe. Alternatively, the encasing member 14 may be a polygonal shaped structure that has an inner channel in which at least a portion of the height adjustment mechanism is positionable. The encasing member 14 may help encase the height adjustment mechanism so that a user is not exposed to pinch points or other aspects of the height adjustment mechanism that could possibly injure the user. The encasing member 14 may also help protect the height adjustment mechanism from exposure to objects that could accidentally come into contact with the chair 1 and cause damage to the height adjustment mechanism 5. For instance, the encasing member may fully enclose the height adjustment mechanism along with the upper portion 6 and base 3 to protect the user and the height adjustment mechanism 5 and also provide a desired aesthetic effect.

The encasing member 14 may be slideable or otherwise movable within the base 3 of the chair 1 such that when the seat 8 is raised via actuation of the height adjustment mechanism 5 the encasing member 14 is slid along the bottom portion of the base or moves within the base 3. The encasing member 14 may also have an upper portion that is slideable along or otherwise movable adjacent the upper portion 6 when the height adjustment mechanism is actuated to lift the seat 8.

In other embodiments, the upper portion 6 may be slideable or otherwise movable relative to the encasing member 14 during height adjustment such that the upper portion 6 slides relative to the encasing member 14 or moves adjacent the encasing member. The encasing member 14 may be attached or movably attached to the upper portion 6 within the upper portion 6 such that the upper portion slides or otherwise moves adjacent an outer surface of the encasing member that is located within the upper portion 6.

In other alternative embodiments, it is contemplated that the encasing member 14 may be slideable or otherwise movable relative to the upper portion 6. It is also contemplated that the base 3 may be slideable or otherwise movable relative to the encasing member in certain embodiments.

In yet other alternative embodiments, it is contemplated that the encasing member 14 may be affixed to the base 3 and the upper portion 6. For such an embodiment, the encasing member 14 may have a telescoping structure that is extendable and retractable. The telescoping structure may include two or more tubular pieces that move such that at least one inner tubular piece is extendable out of an outer tubular piece.

As may be appreciated from FIGS. 3-7, the height adjustment mechanism 5 may include a number of different interconnected elements that are interconnected to adjust the height of the seat 8. For example, the height adjustment mechanism 5 may include a first gas spring 12 that is connected to a second gas spring 17 via a support 22. The first gas spring 12 can have a first extendable member 13 that extends into and out of a first base member 12*a* that is attached to the base 3 within a cavity of the base 3. The first base member 12*a* is affixed to the base 3 and extends vertically within the base adjacent to a top portion of the base 3. The first extendable member 13 may have a first end portion that is movable within the first base member 12*a*. For instance, the end portion may be slid within the base member 12*a* so that the first extendable member 13 can slide into and out of the base member 12*a*. The first extendable member 13 is vertically movable to adjust a height of the seat 8. A bottom portion of the encasing member 14 may slide along or move adjacent a portion of the base when the first extendable member is moved to change a position of the seat.

A first actuator element 15 may be connected to the first strap 7*a* to actuate movement of the first extendable member 13 to adjust the height of the seat. The first actuator element 15 can be a wire, cable, or other element, for example. The first actuator element 15 may extend from the base member 12*a* and/or the first extendable member 13 to the first strap 7*a* so that movement of the first strap causes the first actuator element 15 to move to actuate height adjustment of the first gas spring so that the seat is movable. In some embodiments, the first gas spring 12 may be configured so that a user has to lift his or her weight off the seat 8 to permit height actuation to occur after actuating height adjustment via movement of the first strap 7*a*, such as pulling the strap 7*a* out of the chair or away from the chair.

The first base member 12*a* of the first gas spring 12 may be attached to a bottom portion of the base within the base 3. For instance, a bottom plate 3*a* that defines a bottom of a cavity or channel within the base 3 may have a receptacle 10 formed thereon or attached thereto has a hole or channel sized for receiving and holding the bottom end of the first base member 12*a*. A rounded bottom portion 2 of the base may also be attached to the bottom plate 3*a* via fasteners 3*b* that extend through holes in the plate 3*a*.

A second gas spring 17 is connected between the first gas spring 12 and the upper portion 6 of the chair. The second gas spring 17 can include a receptacle member 27 that is attached to the upper portion 6 of the chair and a second extendable member 25. The second extendable member may be attached to a support 22 and be movable into and out of the receptacle member 27 to adjust a vertical position of the seat 8. For instance, an upper end of the second extendable member 25 can be movable within the receptacle member 27 to adjust the extent to which the second extendable member extends out of the receptacle member 27. An opposite end of the extendable member is attachable to the support 22.

A top portion of the encasing member 14 may slide along or move adjacent a portion of the upper portion 6 when the second extendable member is moved to change a position of the seat. The support 22 may be attached to the first extendable member 13 and also be attached to the second extendable member 25 to interconnect the first and second gas springs 12, 17.

The receptacle member 27 and/or the second extendable member 25 may be attached to a second actuator element 21 that is movable to actuate movement of the second extendable member 25 into and out of the receptacle member 27. The second actuator element 21 may be a wire, cable, or other element attached to the second strap 7*b* or may otherwise extend from the second strap 7*b* to the second gas spring 17 to actuate movement of the second extendable member 25 when the second strap 7*b* is pulled out of the chair or moved away from the upper portion 6 of the chair. In some embodiments, the second gas spring 17 may be configured so that a user has to lift his or her weight off the seat 8 to permit height actuation to occur after actuating height adjustment via movement of the second strap 7*b*, such as pulling the second strap 7*b*.

The support 22 may be configured to have an upper end 22*a* and a lower end 22*b*. The support may also have slanted cavities or channels defined therein that are next to each other. A first channel or cavity may have a first hole 22*d* formed within the support 22 adjacent the upper end 22*a* of the support to receive and be attached to the first extendable member 13. The second channel or cavity may be in communication with a second hole 22*c* formed therein that is sized and shaped to receive an end of the second extendable member 25 so that the second extendable member 25 is attached to the lower end of the support within that second hole 22*c*. The support 22 may be configured so that the interconnection of the first and second gas springs 12 and 17 may take up a relatively small amount of space so that the mechanism has a relatively small sized footprint for being positioned within and between the upper and lower portions of the chair (e.g. base 3 and upper portion 6).

The support 22 may be one member that is cast as an aluminum, steel or other type of metal. In alternative embodiments, it is contemplated that the support 22 could be composed of a composite material or of a polymeric material or may be comprised of interconnected elements.

It should be appreciated that the interconnection of the first and second gas springs 12, 17 can permit a substantial change in height of the seat 8 from a low position that may be located when the upper portion 6 is in contact with the base 3 or is near the base 3 to a high position in which the upper portion 6 is moved substantively far away from the base 3. The arrangement and use of the support 22 can help permit the height adjustment to occur along two different extendable axes (e.g. the length of the first gas spring and the length of the second gas spring, while having the center of gravity for the weight of each gas spring being relatively close to each other as the support 22 helps to transfer the weight of the raised seat 8 and weight of a seated user to the base 3.

The encasing member 14 may be configured to help transfer some weight of the seated user or of the seat 8. The encasing member may be movably attached to the upper portion 6 and movable attached to the base 3 such that only a relatively small amount of weight is transferred via the encasing member 14. Such a design can help permit the encasing member to be made of a relatively low cost polymeric material of any of a number of colors, such as a clear or transparent color. In one embodiment, the encasing member 14 is transparent so that a user or others may see the height adjustment mechanism 5 to provide a desired aesthetic effect. In other alternative embodiments, the encasing member 14 is a color that is configured to contrast with the colors of the upper portion 6 and base 3. In yet other alternative embodiments, the encasing member 14 is configured to be the same color as or a complementary color to both the base 3 and the upper potion 6 or is the same color as only one of these two elements.

The base 3 may include a rounded bottom 2 that is half-hemispherical in shape or otherwise has a bottom surface that is curved or rounded. The rounded bottom 2 may permit the chair to be rockable by a user regardless of how the user is seated on the chair. For instance, the rounded bottom may permit a user to sit on the chair so that his or her feet may be in front of any part of the rounded bottom 2 and still permit the user to rock the chair 1 by shifting his or her weight to cause the rockable bottom to pivot or otherwise rock along the curved bottom surface of the rounded bottom 2.

In some embodiments, the rounded bottom 2 may be attached to the plate 3*a* of the base 3 and be hollow such that there is a cavity within the rounded bottom. The hollow rounded bottom 2 may then be filled with filler to provide a desired weight to the base 3 of the chair to help prevent the chair 1 from being easily toppled over by a user. The weighted filler may be metal pebbles, steel shot, metal shot, or other small particulate material. As another example, the weighted filler may be sand, a dense gel, or a granular material providing a desired weight for the base 3 of the chair. The filler material may fill the entire cavity or may fill only a portion of the cavity defined within the hollow rounded bottom.

Referring to the upper part of the chair, the upper portion 6 may include a top end that has a top plate 6*a* attached thereto. The top plate 6*a* may be attached to the upper end 27*a* of the receptacle 27 of the second gas spring 17 so that movement of the second extendable member 25 raises the upper portion 6 of the chair and seat 8 attached to the upper portion 6. The top plate 6*a* may have holes 6*c* that receive fasteners 6*b*. The fasteners may extend from a portion of a seat member of the seat 8 to the top plate 6*a* to attach the seat to the top end of the upper portion 6 of the chair. The top plate 6*a* may also have an aperture 31 through which the first and second straps 7*a* and 7*b* extend. The straps may extend into a cavity of the upper portion 6 and be attached to an actuator element as noted above. Pulling on each strap may cause a respective actuator element 21, 15 to move to actuate one of the gas springs 12 or 17 to adjust a height of the seat 8. If a user keeps his or her weight on the seat when one or both straps are pulled, the seat may lower. If a user raises his or her weight off of the seat 8 when the straps are pulled, the height adjustment mechanism may lift the seat 8 to a higher position. If a user keeps his or her weight on the seat and pulls one or both straps, the weight of the user on the seat 8 may lower the seat to a lower position via the user's actuation of the height adjustment mechanism. In some embodiments of the chair the first and second straps 7*a* and 7*b* may be replaced with buttons, levers, handles, knobs, or other actuator elements.

In other embodiments of the chair, the actuation of the height adjustment mechanism 5 may occur via manipulation of just one actuator such as one of the first and second straps 7*a*, 7*b*. For instance, the first strap 7*a* may be affixed to the upper portion 6 of the chair and be configured so that a user may pull the first strap 7*a* to slide the chair along a floor to a new location. The second strap 7*b* may be connected to both first and second actuator elements 21 and 15 and be pulled to actuate adjustment of both the first and second gas springs 12, 17. A user may then pull only the second strap 7*b* to actuate height adjustment of the seat 8. Of course, the second strap 7*b* could alternatively be replaced with a mechanical lever, a button, or other actuator element that may be connected to the upper portion 6 and first and second actuator elements 21, 15 to actuate the first and second gas springs 12, 17 for actuating height adjustment. For instance, the second strap 7*b* could be replaced with a button, knob, handle, or lever that is moved to cause the first and second actuator elements 21, 15 to move for actuating movement of the first and second gas springs 12, 17 so that the seat 8 may be moved to a lower or higher position.

The seat 8 includes a support member that supports a cushion. A leather or fabric covering may cover the cushion and be attached to the support member. Alternatively, another type of material may be used to cover the cushion. The support member may then be attached to the top plate 6*a* via a plurality of fasteners 6*b* as noted above to attach the seat 8 to the upper portion 6 of the chair.

In alternative embodiments, the support member of the seat 8 may be rotatably attached to the upper portion of the chair so that the seat 8 is rotatable relative to the upper portion of the chair so that a user may swivel the seat to rotate the seat in 360° or in less than 360°. In other embodiments, the seat 8 may be non-rotatably affixed to the upper portion 6 of the chair.

The upper surface 8*a* of the seat may be flat or be convex in shape. In alternative embodiments, the upper surface 8*a* may be dished so that it is concave in shape or have one or more recesses formed therein. In some alternative embodiments, the seat 8 may merely be a polymeric member that is attached to the upper portion 6 of the chair. In yet other alternatives, the seat 8 may be configured to provide an upper seating surface that is a taught or suspended mesh or elastomeric member that is attached to the upper portion 6 of the chair and may slightly bow into a more concave shape when a user sits on the seat.

In some embodiments, the chair may not include any backrest. For instance, the chair 1 may be configured as a stool. In other embodiments, the chair may include a backrest that is attached to the upper portion 6 of the chair or is attached to the seat 8 of the chair or is attached to both the seat 8 and the upper portion 6 of the chair. In some embodiments, the backrest may be tiltable about its connection to the seat 8, upper portion of the chair 6 or both the seat 8 and upper portion 6 of the chair. In yet other embodiments, it is contemplated that the seat 8 and backrest may be rotatably attached to the upper portion of the chair such that the seat and backrest are rotatable relative to the upper portion of the chair.

It should be appreciated that embodiments of the chair may utilize many different features. For instance, while the height adjustment mechanism 5 has been shown as having first and second extendable members 13 and 25 connected to the support, receptacle members could instead be attached to the support for either or both of the first and second gas springs in alternative designs. For such configurations, it should be understood that the extendable member of the first gas spring would be attached to the base 3 when the first base member 12*a* would be attached to the support 22 and the extendable member 25 of the second gas spring would be attached to the upper portion 6 when the receptacle member 27 would be attached to the support 22.

As another example, the seat may be a unitary structure composed of polymeric material or may be a structure that has many interconnected components, such as a foam member that is positioned between a fabric or leather covering and a rigid plate. For instance, the seat may include a covering that may be a fabric or mesh material that is sewn, adhered or otherwise attached to a rigid plate to enclose a foam member, such as a foam cushion.

As yet another example, it should be appreciated that the shape and configuration of the base of the chair may be any of a number of different configurations needed to meet a particular design objective that permit the base to support both the seat.

As yet another example, the height adjustment mechanism used to actuate seat height adjustment may include only one gas spring or may include another type of lifting mechanism and the actuator used to actuate height adjustment may include a button, lever, or other actuator that is coupled to a component of the height adjustment mechanism via a connector such as a wire or cable or lever such that manipulation of the actuator causes the height adjustment mechanism to move to adjust the height of the seat.

Therefore it should be understood that while certain present preferred chairs and methods of making and using chairs have been discussed and illustrated herein, it is to be distinctly understood that the invention is not limited thereto but may be otherwise variously embodied and practiced within the scope of the following claims.

What is claimed is:

1. A seating device comprising:

a base;

a seat assembly comprising a seat;

a height adjustment mechanism attached between the base and the seat assembly, the height adjustment mechanism configured to vertically move a position of the seat from a first position to a second position that is higher than the first position, the height adjustment mechanism comprising:

a first gas spring attached to the base, a second gas spring attached to the seat assembly, and a support attached between the first gas spring and the second gas spring;

the first gas spring being at least partially within a lower portion of the base and the second gas spring being at least partially within the seat assembly, the seat assembly being moveable relative to the lower portion of the base;

the seat assembly also comprising a seat member that is attached to an upper portion of the seating device, the upper portion being moveably attached to the base via the height adjustment mechanism;

an encasing member moveably attached to at least one of the base and the upper portion of the seating device, the encasing member being slidable along a portion of the base when the seat is raised from the first position to the second position via movement of the first gas spring and wherein the encasing member is also slidable along a portion of the upper portion of the seating device when the seat is raised from the first position to the second position via movement of the second gas spring.

2. The seating device of claim 1 wherein the encasing member is positioned to encase at least a portion of the height adjustment mechanism such that the height adjustment mechanism is fully encased between the base, the upper portion of the seating device, and the encasing member.

3. The seating device of claim 1 wherein the encasing member is comprised of a material such that the encasing member is clear and at least portions of the first and second gas spring are viewable through the encasing member when the seat is in the second position.

4. The seating device of claim 1 wherein the seating device is a stool.

5. The seating device of claim 1 further comprising a first actuator and a second actuator, the first actuator moveably attached to the first gas spring to actuate movement of a first extendable member of the first gas spring for vertical movement of the seat, the second actuator moveably attached to the second gas spring to actuate movement of a second extendable member of the second gas spring for vertical movement of the seat.

6. The seating device of claim 1 wherein the height adjustment mechanism is also configured to vertically move a position of the seat from the second position to the first position.

7. The seating device of claim 1 wherein the seat member is configured to support at least one of a cushion and a covering positioned over the cushion.

8. The seating device of claim 1, wherein the seat member is configured to attach the seat to the upper portion of the seating device.

9. The seating device of claim 1 wherein the first gas spring is comprised of a base member that is attached to the support and a first extendable member that has a first end moveably positioned within the base member and a second end that is attached to the base; and the second gas spring is comprised of a receptacle member attached to the support and a second extendable member, the second extendable member having a first end that is moveable within the receptacle member and a second end that is attached to the seat assembly.

10. The seating device of claim 9 wherein the support has an upper end and a lower end, the base member of the first gas spring being attached adjacent to the upper end of the support and the base member of the second gas spring being attached adjacent to the lower end of the support.

11. The seating device of claim 1 wherein the encasing member is attached to both the base and the seat assembly.

12. The seating device of claim 11 wherein the encasing member is positioned to encase at least a portion of the height adjustment mechanism such that the height adjustment mechanism is fully encased between the base, the seat assembly and the encasing member.

13. The seating device of claim 12 wherein the encasing member is comprised of a material such that the encasing member is clear and at least portions of the first and second gas spring are viewable through the encasing member when the seat is in the second position.

14. The seating device of claim 1 wherein the first gas spring is comprised of a base member that is attached to the base of the seating device and a first extendable member that has a first end moveably positioned within the base member and a second end that is attached to the support; and the second gas spring is comprised of a receptacle member attached to the seat assembly and a second extendable member, the second extendable member having a first end that is moveable within the receptacle member and a second end that is attached to the support.

15. The seating device of claim 14 wherein the support has an upper end and a lower end, the second end of the first extendable member being attached adjacent to the upper end of the support and the second end of the second extendable member being attached adjacent to the lower end of the support.

16. The seating device of claim 15 wherein the support has first hole defined within the upper end of the support to receive and retain the second end of the first extendable member of the first gas spring and the support has a second hole defined within the lower end of the support to receive and retain the second end of the second extendable member of the second gas spring.

17. The seating device of claim 16 wherein the support has a first side and a second side opposite the first side, the first hole being defined on the first side of the support and the second hole being defined on the second side of the support.

18. A seating device comprising:

a base;

an upper portion that is moveable relative to the base;

a seat attached to the upper portion;

a height adjustment mechanism attached between the base and the upper portion, the height adjustment mechanism configured to vertically move a position of the seat from a first position to a second s position that is higher or lower than the first position, the height adjustment mechanism comprising:

a first gas spring having a base member and a first extendable member being extendable out of the base member, a second gas spring having a receptacle member and a second extendable member being extendable out of the receptacle member, and a support attached between the first gas spring and the second gas spring, one of the base member and the first extendable member attached to the support and the other of the base member and the first extendable member attached to the base, one of the receptacle member and the second extendable member attached to the upper portion and the other of the receptacle member and the second extendable member attached to the support; and the first gas spring being at least partially within a lower portion of the base and the second gas spring being at least partially within the upper portion of the seating device;

an encasing member that is moveably attached to at least one of the base and the upper portion, the encasing member being positioned to encase at least a portion of the height adjustment mechanism such that the height adjustment mechanism is fully encased between the base, the upper portion, and the encasing member, the encasing member being slidable along a portion of the base when the seat is raised from the first position to the second position via movement of the first gas spring, and wherein the encasing member is also slidable along a portion of the upper portion of the seating device when the seat is raised from the first position to the second position via movement of the second gas spring.

19. The seating device of claim 18 wherein the encasing member is comprised of a material such that the encasing member is clear and at least portions of the first and second gas spring are viewable through the encasing member when the seat is in the second position.

20. The seating device of claim 18 wherein the base has a rounded bottom such that the seating device is rockable.

21. The seating device of claim 18 wherein the seating device is a stool.

22. The seating device of claim 18 wherein the height adjustment mechanism is also configured to vertically move a position of the seat from the second position to the first position.

23. The seating device of claim 18 wherein the support has an upper end and a lower end, an end of the one of the first extendable member and the base member being attached adjacent to the upper end of the support and an end of the one of the second extendable member and the receptacle member of the second gas spring being attached adjacent to the lower end of the support.

24. The seating device of claim 23 wherein the support has a first hole defined within the upper end of the support to receive and retain the end of the one of the first extendable member and the base member and the support has a second hole defined within the lower end of the support to receive and retain the end of the one of the second extendable member and the receptacle member of the second gas spring.

25. The seating device of claim 24 wherein the support has a first side and a second side opposite the first side, the first hole being defined on the first side of the support and the second hole being defined on the second side of the support.

* * * * *